US010674304B2

(12) United States Patent
Kim et al.

(10) Patent No.: US 10,674,304 B2
(45) Date of Patent: Jun. 2, 2020

(54) SIGNAL PROCESSING APPARATUS AND SIGNAL PROCESSING METHOD

(71) Applicant: SONY CORPORATION, Tokyo (JP)

(72) Inventors: Heesoon Kim, Kanagawa (JP); Masaharu Yoshino, Saitama (JP); Masahiko Inami, Kanagawa (JP); Kouta Minamizawa, Tokyo (JP); Yuta Sugiura, Tokyo (JP); Shunichi Kasahara, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/761,647

(22) PCT Filed: Sep. 21, 2016

(86) PCT No.: PCT/JP2016/077869
§ 371 (c)(1),
(2) Date: Mar. 20, 2018

(87) PCT Pub. No.: WO2017/061278
PCT Pub. Date: Apr. 13, 2017

(65) Prior Publication Data

US 2018/0352361 A1 Dec. 6, 2018

(30) Foreign Application Priority Data

Oct. 9, 2015 (JP) ..... 2015-200900

(51) Int. Cl.
*H04S 7/00* (2006.01)

(52) U.S. Cl.
CPC ..... *H04S 7/303* (2013.01); *H04S 7/30* (2013.01); *H04S 7/301* (2013.01); *H04S 2400/11* (2013.01); *H04S 2400/15* (2013.01)

(58) Field of Classification Search
CPC .. H04S 7/303; H04S 2400/11; H04S 2400/15; G10H 1/009; G10K 15/08
(Continued)

(56) References Cited

U.S. PATENT DOCUMENTS 5,559,891 A * 9/1996 Kuusama ..... G10K 15/08 381/63
2003/0065657 A1* 4/2003 Hashimoto ..... G06F 16/739
(Continued)

FOREIGN PATENT DOCUMENTS

CN 101690150 A 3/2010
EP 2145465 A2 1/2010
(Continued)

OTHER PUBLICATIONS

International Search Report and Written Opinion of PCT Application No. PCT/JP2016/077869, dated Nov. 29, 2016, 11 pages.

*Primary Examiner* — William A Jerez Lora
(74) *Attorney, Agent, or Firm* — Chip Law Group

(57) ABSTRACT

Provided is a signal processing apparatus that can replicate, in a real space, an environment different from the real space by granting an acoustic characteristic different from that of the real space, to a sound released in the real space. There is provided a signal processing apparatus including a control unit configured to decide a predetermined acoustic characteristic for causing a user to hear a collected ambient sound of the user in a space having a different acoustic characteristic, in accordance with content being reproduced, or an action of a user, and to add the decided acoustic characteristic to the ambient sound.

7 Claims, 11 Drawing Sheets

(58) Field of Classification Search
USPC ..... 381/17, 63, 124, 303
See application file for complete search history.

(56) References Cited

U.S. PATENT DOCUMENTS

| | | | | |
|---|---|---|---|---|
| 2005/0195984 | A1* | 9/2005 | Miura | H04S 7/301 381/63 |
| 2006/0107822 | A1* | 5/2006 | Bowen | G10H 1/0008 84/612 |
| 2009/0106670 | A1* | 4/2009 | Berndt | H04L 12/1822 715/757 |
| 2012/0258798 | A1* | 10/2012 | Cullen | A63F 13/63 463/36 |
| 2013/0314599 | A1* | 11/2013 | Kikugawa | H04N 5/91 348/571 |
| 2016/0210775 | A1* | 7/2016 | Alaniz | G05D 1/0088 |
| 2017/0054899 | A1* | 2/2017 | Sadhwani | H04N 5/23222 |

FOREIGN PATENT DOCUMENTS

| | | | |
|---|---|---|---|
| JP | 04-306100 | A | 10/1992 |
| JP | 2000-194460 | A | 7/2000 |
| JP | 2013-243619 | A | 12/2013 |
| WO | 2008/125593 | A2 | 10/2008 |

* cited by examiner

SIGNAL PROCESSING APPARATUS AND SIGNAL PROCESSING METHOD

CROSS REFERENCE TO RELATED APPLICATIONS

This application is a U.S. National Phase of International Patent Application No. PCT/JP2016/077869 filed on Sep. 21, 2016, which claims priority benefit of Japanese Patent Application No. JP 2015-200900 filed in the Japan Patent Office on Oct. 9, 2015. Each of the above-referenced applications is hereby incorporated herein by reference in its entirety.

TECHNICAL FIELD

The present disclosure relates to a signal processing apparatus, a signal processing method, and a computer program.

BACKGROUND ART

A technology for causing listeners to hear a realistic sound has conventionally existed. For causing listeners to hear a realistic sound, for example, a sound in content is stereophonically reproduced, or a certain acoustic characteristic is added to a sound in content, and the resultant sound is reproduced. Examples of technologies of stereophonic reproduction include a technology of generating surround audio such as 5.1 channel and 7.1 channel, and a technology of performing reproduction while switching between a plurality of sound modes (soccer stadium mode, concert hall mode, etc.). For switching between modes in the latter technology, a space characteristic has been recorded, and an effect has been added to a sound in content (e.g., refer to Patent Literature 1).

CITATION LIST

Patent Literature

Patent Literature 1: JP H6-186966A

DISCLOSURE OF INVENTION

Technical Problem

Nevertheless, any of the aforementioned technologies remains at a point concerning how a sound in content is reproduced. As for a sound released in a real space, in any case, reverberation or the like of the sound is performed in accordance with an acoustic characteristic of the real space. Thus, no matter how realistic a sound in content is reproduced, a listener feels a sense of separation between a real space and a content space.

In view of the foregoing, the present disclosure proposes a signal processing apparatus, a signal processing method, and a computer program that are novel and improved, and can replicate, in a real space, an environment different from the real space by granting an acoustic characteristic different from that of the real space, to a sound released in the real space.

Solution to Problem

According to the present disclosure, there is provided a signal processing apparatus including: a control unit configured to decide a predetermined acoustic characteristic for causing a user to hear a collected ambient sound of the user in a space having a different acoustic characteristic, in accordance with content being reproduced, or an action of a user, and to add the decided acoustic characteristic to the ambient sound.

In addition, according to the present disclosure, there is provided a signal processing method including: executing, by a processor, processing of deciding a predetermined acoustic characteristic for causing a user to hear a collected ambient sound of the user in a space having a different acoustic characteristic, in accordance with content being reproduced, or an action of a user, and adding the decided acoustic characteristic to the ambient sound.

In addition, according to the present disclosure, there is provided a computer program for causing a computer to execute: deciding a predetermined acoustic characteristic for causing a user to hear a collected ambient sound of the user in a space having a different acoustic characteristic, in accordance with content being reproduced, or an action of a user, and adding the decided acoustic characteristic to the ambient sound.

Advantageous Effects of Invention

As described above, according to the present disclosure, a signal processing apparatus, a signal processing method, and a computer program that are novel and improved, and can replicate, in a real space, an environment different from the real space by granting an acoustic characteristic different from that of the real space, to a sound released in the real space can be provided.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
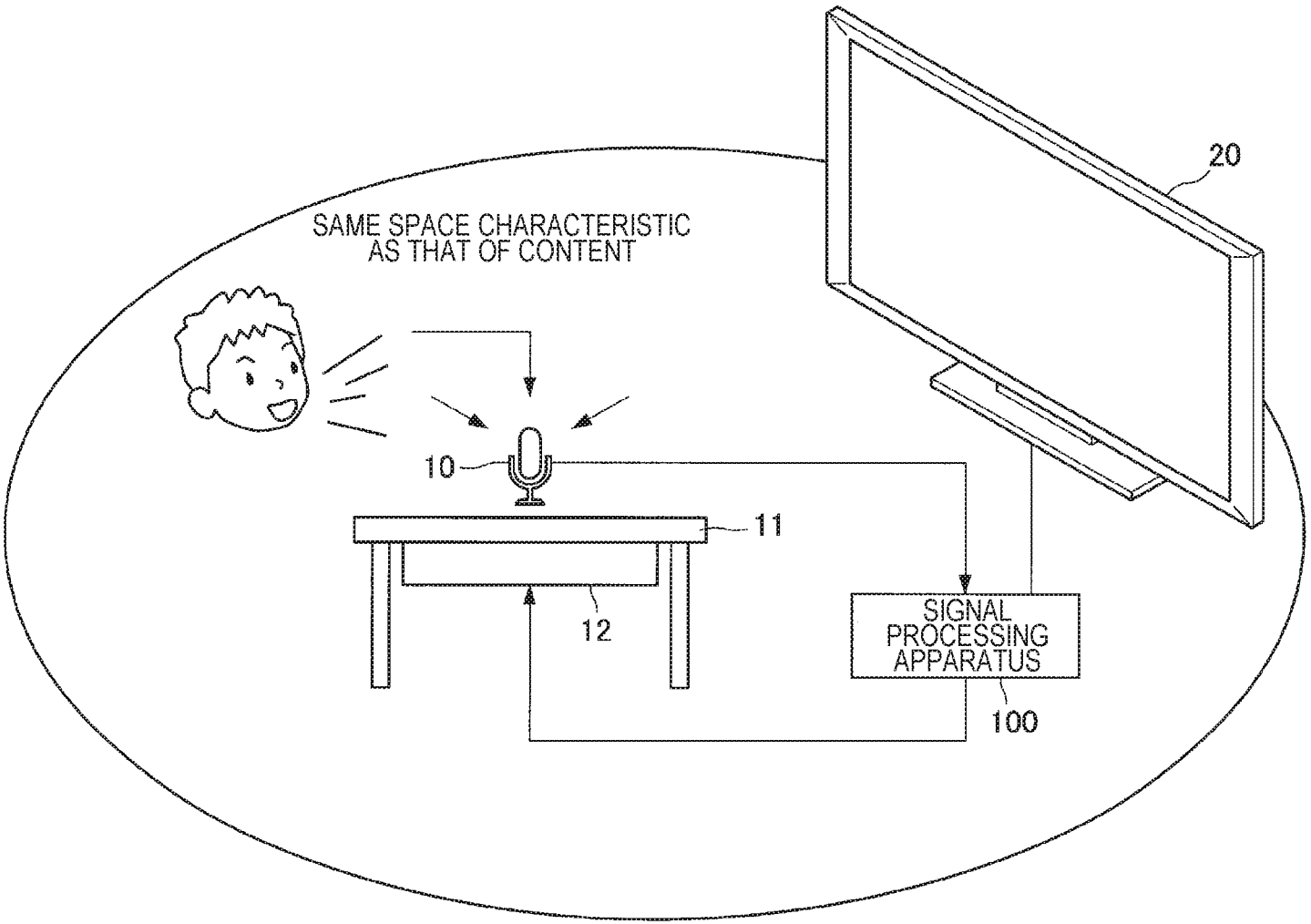
FIG. 1 is an explanatory diagram that describes an overview of an embodiment of the present disclosure.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that the description will be given in the following order.

1. Embodiment of Present Disclosure
1.1. Overview
1.2. First Configuration Example and Operation Example
1.3. Second Configuration Example and Operation Example
1.4. Third Configuration Example and Operation Example
1.5. Fourth Configuration Example and Operation Example
1.6. Fifth Configuration Example
1.7. Modified Example
2. Conclusion

1. EMBODIMENT OF PRESENT DISCLOSURE

[1.1. Overview]

First of all, an overview of an embodiment of the present disclosure will be described. FIG. 1 is an explanatory diagram that describes an overview of an embodiment of the present disclosure.

A signal processing apparatus 100 illustrated in FIG. 1 is an apparatus that performs signal processing of adding, to a sound emitted in a physical space (real space) in which a microphone 10 is placed, an acoustic characteristic of another space. By performing the signal processing of adding an acoustic characteristic of another space to a sound emitted in the real space, the signal processing apparatus 100 can bring about an effect of replicating another space in the real space, or expanding the real space with another space.

The microphone 10 placed on a table 11 collects a sound emitted in the real space. For example, the microphone 10 collects a sound of conversation made by humans, and a sound emitted when an object is placed on the table 11. The microphone 10 outputs the collected sound to the signal processing apparatus 100.

The signal processing apparatus 100 performs signal processing of adding an acoustic characteristic of another space to a sound collected by the microphone 10. For example, the signal processing apparatus 100 identifies an acoustic characteristic of another space from content being output by a display device 20 placed in the real space, and adds the acoustic characteristic to a sound collected by the microphone 10. The signal processing apparatus 100 then outputs a signal obtained after the signal processing, to a speaker 12. The speaker 12 is placed on a back surface of the table 11 or the like, for example.

For example, in a case where content being output by the display device 20 is a scene in a cave, when a human in the real space emits a sound, the signal processing apparatus 100 adds an acoustic characteristic of reverberating the emitted sound in the same manner as in the cave in the content.

In addition, for example, in a case where content being output by the display device 20 is a concert video, when a human in the real space emits a sound, the signal processing apparatus 100 adds an acoustic characteristic of reverberating the emitted sound in the same manner as in a concert hall in the content. Note that, also in the case of reproducing concert music without displaying the video, the signal processing apparatus 100 can similarly replicate a space.

In addition, for example, in a case where content being output by the display device 20 is an outer space movie, when a human in the real space emits a sound, the signal processing apparatus 100 can make the actually-emitted sound difficult to hear, and replicate a space like a vacuum outer space, by adding, as an effect, a sound having a phase opposite to that of the emitted sound, for example.

In addition, for example, in a case where content being output by the display device 20 is content mainly including a water surface, when a human in the real space emits a sound, the signal processing apparatus 100 replicates a water surface space by adding, to the sound emitted in the real space, a reverberant sound heard as if an object dropped on a water surface. In addition, for example, in a case where content being output by the display device 20 is a video of an underwater space, when a human in the real space emits a sound, the signal processing apparatus 100 adds a reverberation heard as if a sound were emitted under water.

In addition, for example, in a case where content being output by the display device 20 is content of a virtual space such as, for example, game content, when a human in the real space emits a sound, the signal processing apparatus 100 applies an acoustic characteristic of the virtual space to the sound emitted in the physical space, and outputs the resultant sound.

For example, in a case where a video in game content is a video of a cave, the signal processing apparatus 100 reverberates a sound in the real space as if a listener existed in a cave space. In addition, for example, in a case where a video in the game content is a video taken under water, the signal processing apparatus 100 reverberates a sound in the real space as if a listener existed under water. In addition, for example, in a case where a video in the game content is a video of a science fiction (SF), the signal processing apparatus 100 adds, as reverberation, a breath sound of a character appearing in the content, or the like, to a sound emitted in the real space, and outputs the resultant sound. By thus applying an acoustic characteristic of a virtual space to a sound emitted in the physical space, and outputting the resultant sound, the signal processing apparatus 100 can expand the real space to a virtual space.

The signal processing apparatus 100 may dynamically switch a space to be replicated, for each scene of content being output by the display device 20. By dynamically switching an acoustic characteristic to be added to a sound emitted in the real space, in conjunction with a scene of the content being output by the display device 20, for example, each time a scene switches even in one piece of content, the signal processing apparatus 100 can continue to cause a human existing in the real space to experience the same space as the scene.

For example, if content being output by the display device 20 is a movie, and a scene under water appears in the movie, the signal processing apparatus 100 adds such an acoustic characteristic that a listener feels as if the listener existed under water, and when the scene is switched and a scene in a cave appears, the signal processing apparatus 100 adds such an acoustic characteristic that a listener feels as if the listener existed in a cave.

By the speaker 12 outputting a sound on which signal processing has been performed by the signal processing apparatus 100, a human positioned in a real space can hear a sound emitted in the real space as if the sound were a sound emitted in a space in content being output by the display device 20.

In this manner, the signal processing apparatus 100 executes signal processing of causing a sound emitted in a real space to be heard as if the sound were a sound emitted in a space in content being output by the display device 20. Note that FIG. 1 illustrates a state in which the microphone 10 is placed on the table 11, and the speaker 12 is provided on the back surface of the table 11. Nevertheless, the present disclosure is not limited to this example. For example, the microphone 10 and the speaker 12 may be built in the display device 20. Furthermore, the microphone 10 and the speaker 12 are only required to be placed in the same room as a room in which the display device 20 is placed.

Figure 2:
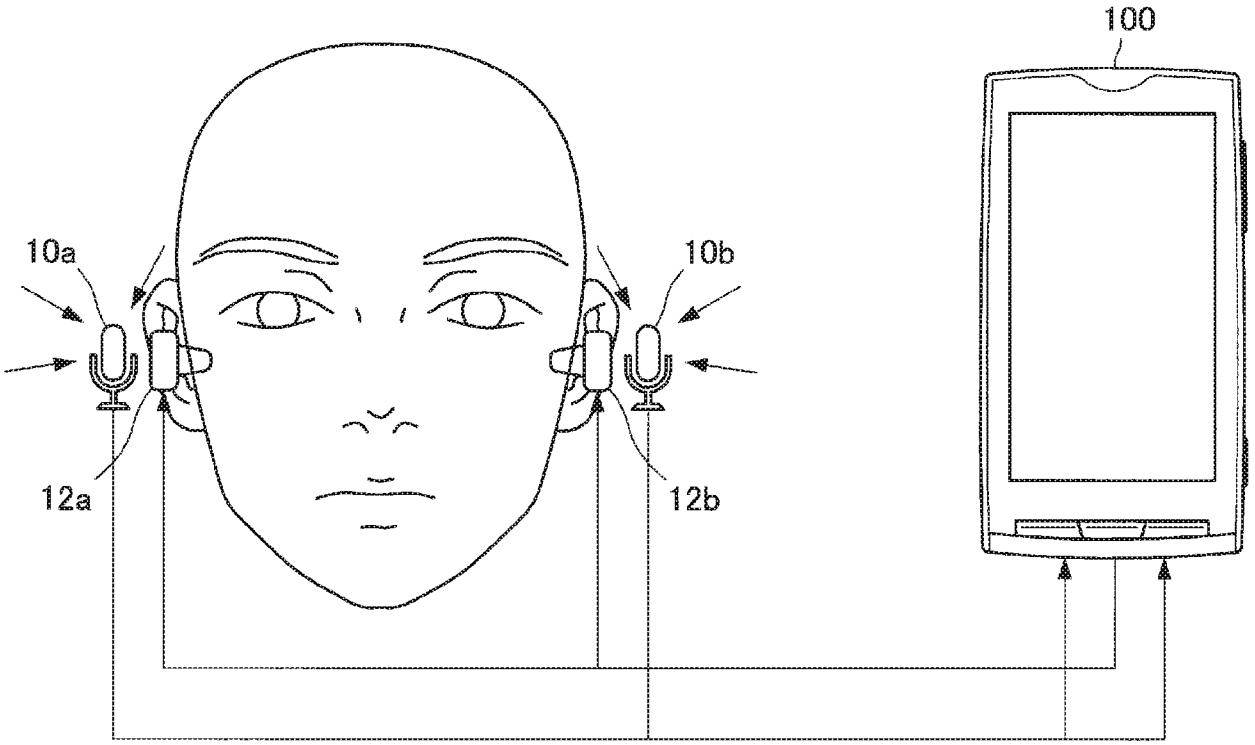
FIG. 2 is an explanatory diagram that describes an overview of an embodiment of the present disclosure.

FIG. 2 is an explanatory diagram that describes an overview of the embodiment of the present disclosure. FIG. 2 illustrates a configuration example of a system in which the signal processing apparatus 100 configured as a device such as a smartphone, for example, performs processing of adding an acoustic characteristic of another space on the basis of content being reproduced by the signal processing apparatus 100.

A listener puts earphones 12*a* and 12*b* connected to the signal processing apparatus 100, on his/her ears, and when microphones 10*a* and 10*b* provided in the earphones 12*a* and 12*b* collect a sound in a real space, the signal processing apparatus 100 executes signal processing on the sound collected by the microphones 10*a* and 10*b*. This signal processing is processing of adding an acoustic characteristic of another space on the basis of content being reproduced by the signal processing apparatus 100.

The microphones 10*a* and 10*b* collect voice emitted by the listener himself/herself, and a sound emitted around the listener. The signal processing apparatus 100 performs signal processing of adding an acoustic characteristic of another space, on a sound in the real space that has been collected by the microphones 10*a* and 10*b*, and outputs the sound obtained after the signal processing, from the earphones 12*a* and 12*b*.

For example, in a case where a listener is listening to a live sound source of a concert, using the signal processing apparatus 100, in a real space of being on a train, the signal processing apparatus 100 adds an acoustic characteristic of a concert hall to voice and noise of surrounding people existing in the real space (on the train), and outputs the resultant voice and noise from the earphones 12*a* and 12*b*. By adding an acoustic characteristic of a concert hall to voice and noise of surrounding people existing in the real space (on the train), and outputting the resultant voice and noise, the signal processing apparatus 100 can replicate a concert hall space while treating people including other people existing on the train, as people existing in the concert hall space.

Content may be created by recording a sound using the microphones 10*a* and 10*b*, and furthermore, adding an acoustic characteristic of a space of a location where the sound has been recorded. The signal processing apparatus 100 replicates a more real space by feeling a space of a location where a sound has been actually recorded as a binaural stereophonic sound, and at the same time, adding, also to a sound emitted in a real space, an acoustic characteristic of the location where the sound has been recorded, and outputting the resultant sound.

Even in a case where a plurality of people views the same content, an acoustic characteristic to be added to a sound emitted in a real space can be switched for each signal processing apparatus 100. The signal processing apparatus 100 enables listeners to feel their respective spaces because different acoustic characteristics are added to the sound emitted in the real space even through the plurality of people views the same content in the same real space.

The overview of the embodiment of the present disclosure has been described above. Subsequently, the description will be given by exemplifying several configuration examples and operation examples of the embodiment of the present disclosure.

[1.2. First Configuration Example and Operation Example]

Figure 3:
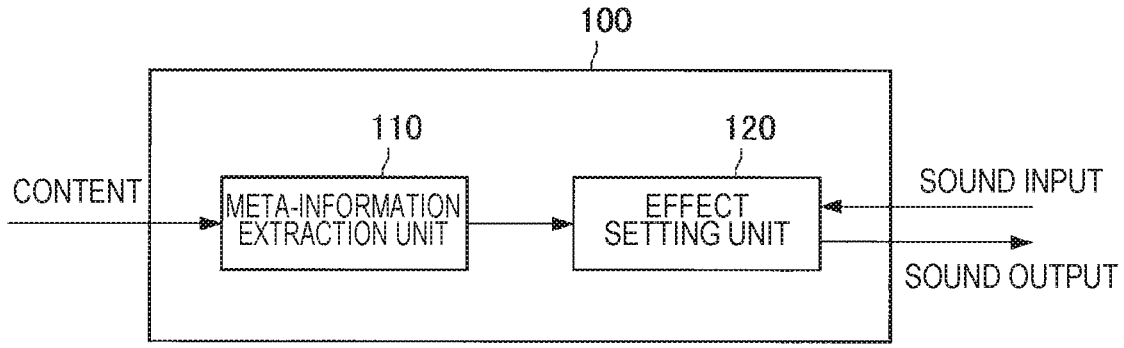
FIG. 3 is an explanatory diagram illustrating a first configuration example of a signal processing apparatus.

First of all, the first configuration example and operation example of the signal processing apparatus 100 according to the embodiment of the present disclosure will be described. FIG. 3 is an explanatory diagram illustrating the first configuration example of the signal processing apparatus 100 according to the embodiment of the present disclosure. By pre-granting meta-information such as a parameter and an effect name of an effect for a sound in a real space, to content being reproduced (by the display device 20 or the signal processing apparatus 100), and extracting the meta-information from the content, the first configuration example illustrated in FIG. 3 sets a parameter of effect processing for a sound in the real space.

As illustrated in FIG. 3, the signal processing apparatus 100 includes a meta-information extraction unit 110 and an effect setting unit 120.

The meta-information extraction unit 110 extracts meta-information from content being reproduced. The meta-information extraction unit 110 extracts, as meta-information, for example, meta-information such as a parameter and an effect name of an effect that has been pre-granted to the content. The meta-information extraction unit 110 outputs the extracted meta-information to the effect setting unit 120.

The meta-information extraction unit 110 may execute the extraction of meta-information at predetermined intervals, or may execute the extraction at a time point at which switching of meta-information is detected.

The effect setting unit 120 is an example of a control unit of the present disclosure, and performs signal processing of adding an acoustic characteristic of another space in content being reproduced, to a sound emitted in a real space, by performing effect processing on the sound emitted in the real space. When performing the signal processing of adding an acoustic characteristic of another space, the effect setting unit 120 then sets a parameter of the effect processing for the sound emitted in the real space, using the meta-information extracted by the meta-information extraction unit 110.

For example, if the meta-information output by the meta-information extraction unit 110 is a parameter of an effect, the effect setting unit 120 sets a parameter of the effect processing for the sound emitted in the real space, on the basis of the parameter. In addition, for example, if the meta-information output by the meta-information extraction unit 110 is an effect name, the effect setting unit 120 sets a parameter of the effect processing for the sound emitted in the real space, on the basis of the effect name.

In the case of granting such an effect that a listener feels as if the listener existed in a cave, for example, the effect setting unit 120 applies an echo to a sound emitted in a real space, as an effect, and elongates a persistence time of the sound. In addition, for example, in the case of granting such an effect that a listener feels as if the listener existed under water, the effect setting unit 120 applies such an effect that bubbles are generated, to a sound emitted in a real space.

When the effect setting unit 120 sets a parameter of effect processing for a sound emitted in a real space, using meta-information extracted by the meta-information extraction unit 110, the effect setting unit 120 executes the effect processing for the sound emitted in the real space, using the parameter, and outputs a sound obtained after the effect processing.

By having a configuration as illustrated in FIG. 3, the signal processing apparatus 100 can set a parameter of effect processing for a sound in a real space, on the basis of meta-information pre-granted to content being reproduced (by the display device 20 or the signal processing apparatus 100).

Figure 4:
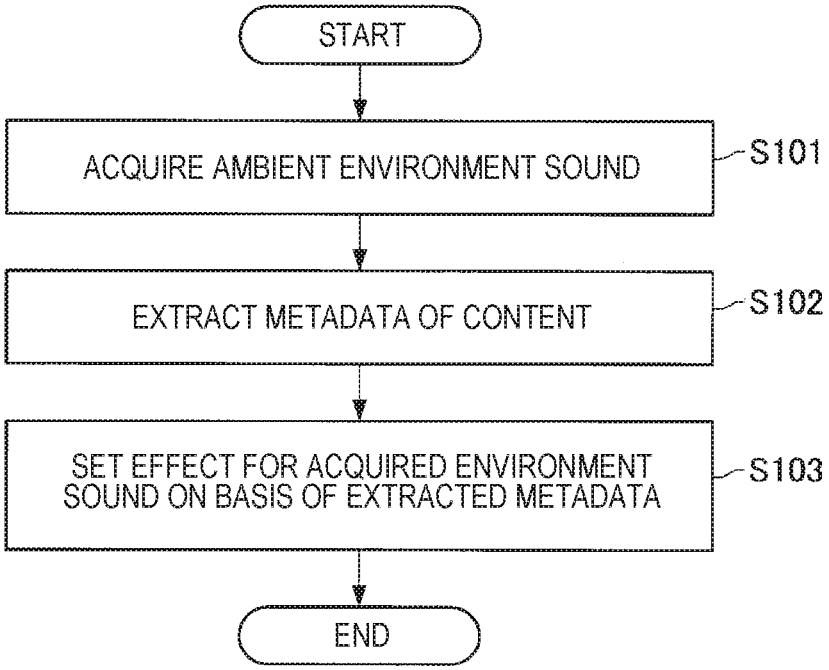
FIG. 4 is a flow chart illustrating a first operation example of the signal processing apparatus.

FIG. 4 is an explanatory diagram illustrating the first operation example of the signal processing apparatus 100 according to the embodiment of the present disclosure. By pre-granting meta-information such as a parameter and an effect name of an effect for a sound in a real space, to content being reproduced (by the display device 20 or the signal processing apparatus 100), and extracting the meta-information from the content, the first operation example illustrated in FIG. 4 sets a parameter of effect processing for a sound in the real space.

First of all, the signal processing apparatus 100 continuously acquires an ambient environment sound emitted in a real space (step S101). The acquisition of the environment sound is performed by, for example, the microphone 10 illustrated in FIG. 1 or the microphones 10*a* and 10*b* illustrated in FIG. 2.

The signal processing apparatus 100 extracts meta-information from content being reproduced (step S102). The signal processing apparatus 100 extracts, as meta-information, for example, meta-information such as a parameter and an effect name of an effect that has been pre-granted to the content. The signal processing apparatus 100 may execute the extraction of meta-information at predetermined intervals, or may execute the extraction at a time point at which switching of meta-information is detected.

When the signal processing apparatus 100 extracts the meta-information from the content being reproduced, the signal processing apparatus 100 then sets a parameter of effect processing to be executed on the environment sound acquired in step S101 described above, using the meta-information acquired in step S102 described above (step S103). When the signal processing apparatus 100 sets the parameter of the effect processing, the signal processing apparatus 100 executes the effect processing for the environment sound acquired in step S101 described above, using the parameter, and outputs a sound obtained after the effect processing.

By executing the operations as illustrated in FIG. 4, the signal processing apparatus 100 can set a parameter of effect processing for a sound in a real space, on the basis of meta-information pre-granted to content being reproduced (by the display device 20 or the signal processing apparatus 100).

[1.3. Second Configuration Example and Operation Example]

Figure 5:
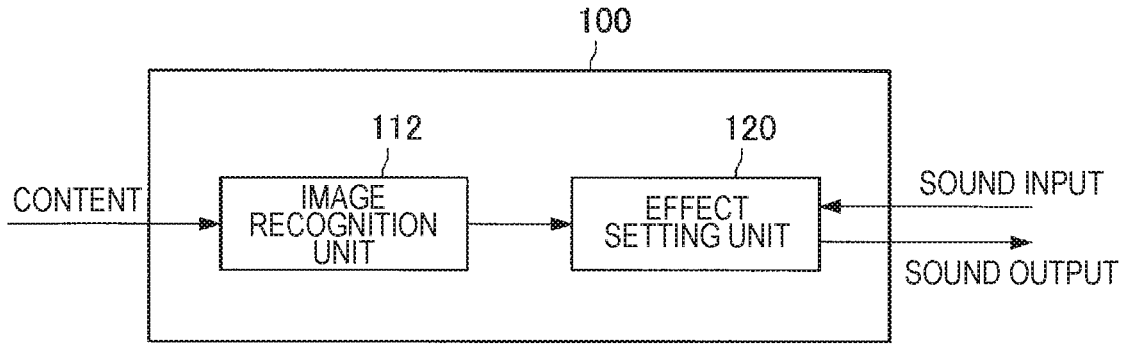
FIG. 5 is an explanatory diagram illustrating a second configuration example of a signal processing apparatus.

Next, the second configuration example and operation example of the signal processing apparatus 100 according to the embodiment of the present disclosure will be described. FIG. 5 is an explanatory diagram illustrating the second configuration example of the signal processing apparatus 100 according to the embodiment of the present disclosure. The second configuration example illustrated in FIG. 5 performs image recognition processing for content being reproduced (by the display device 20 or the signal processing apparatus 100), and sets a parameter of effect processing for a sound in a real space, from a result of the image recognition processing.

As illustrated in FIG. 5, the signal processing apparatus 100 includes an image recognition unit 112 and the effect setting unit 120.

The image recognition unit 112 executes image recognition processing for content being reproduced. Because a parameter of effect processing for a sound in a real space is set from a result of the image recognition processing, the image recognition unit 112 performs image recognition processing to such a degree that it is possible to identify the type of location used for a scene of content being reproduced. When the image recognition unit 112 executes image recognition processing for the content being reproduced, the image recognition unit 112 outputs a result of the image recognition processing to the effect setting unit 120.

For example, if a large amount of seas, rivers, lakes, or the like are included in a video, the image recognition unit 112 can recognize that content being reproduced is a scene of a location near water, or a scene under water. In addition, for example, if a video is dark, and a large amount of rock surfaces or the like are included in the video, the image recognition unit 112 can recognize that content being reproduced is a scene in a cave.

The image recognition unit 112 may execute image recognition processing for each frame. Nevertheless, because it is extremely rare for a scene to frequently switch for each frame, image recognition processing may be executed at predetermined intervals for reducing processing load.

By performing effect processing on a sound emitted in a real space, the effect setting unit 120 performs signal processing of adding an acoustic characteristic of another space in content being reproduced, to the sound emitted in the real space. When performing the signal processing of adding an acoustic characteristic of another space, the effect setting unit 120 then sets a parameter of effect processing for the sound emitted in the real space, using the result of the image recognition processing performed by the image recognition unit 112.

For example, in a case where content being reproduced is recognized as a scene of a location near water, or a scene under water, as a result of image recognition processing performed by the image recognition unit 112, the effect setting unit 120 sets a parameter of effect processing of adding a reverberant sound heard as if an object dropped on a water surface, or adding reverberation heard as if a sound were emitted under water.

In addition, for example, in a case where content being reproduced is recognized as a scene in a cave, as a result of image recognition processing performed by the image recognition unit 112, the effect setting unit 120 sets a parameter of effect processing of adding such reverberation that a listener feels as if the listener existed in a cave.

When the effect setting unit 120 sets a parameter of effect processing for a sound emitted in a real space, using a result of image recognition processing performed by the image recognition unit 112, the effect setting unit 120 executes the effect processing for the sound emitted in the real space, using the parameter, and outputs a sound obtained after the effect processing.

By having a configuration as illustrated in FIG. 5, the signal processing apparatus 100 can set a parameter of effect processing for a sound in a real space, on the basis of what is included in content being reproduced. In other words, by having a configuration as illustrated in FIG. 5, the signal processing apparatus 100 can set a parameter of effect processing for a sound in a real space, on the basis of what is included in content being reproduced, even for content to which meta-information is not added.

Figure 6:
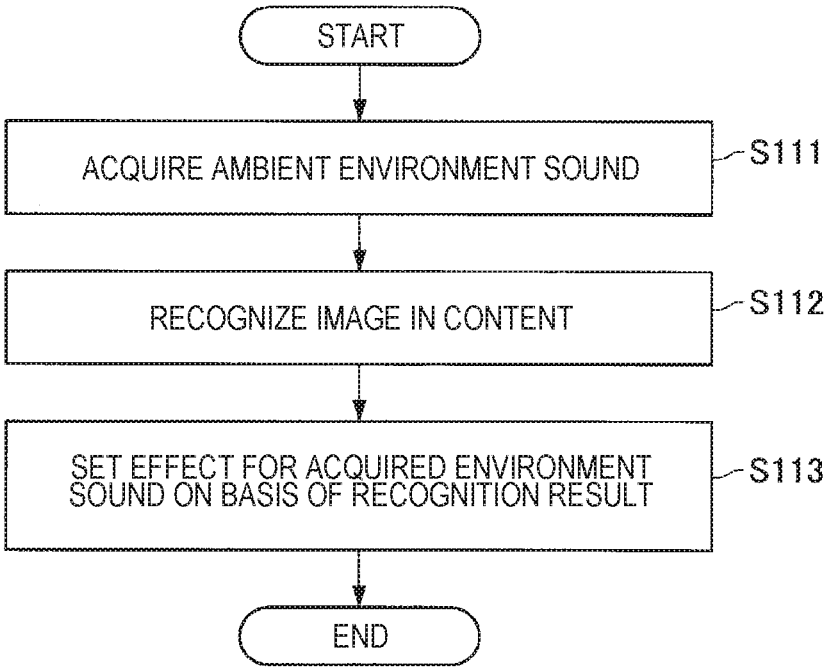
FIG. 6 is a flow chart illustrating a second operation example of the signal processing apparatus.

FIG. 6 is an explanatory diagram illustrating the second operation example of the signal processing apparatus 100 according to the embodiment of the present disclosure. The second operation example illustrated in FIG. 6 performs image recognition processing for content being reproduced (by the display device 20 or the signal processing apparatus 100), and sets a parameter of effect processing for a sound in a real space, from a result of the image recognition processing.

First of all, the signal processing apparatus 100 continuously acquires an ambient environment sound emitted in a real space (step S111). The acquisition of the environment sound is performed by, for example, the microphone 10 illustrated in FIG. 1 or the microphones 10*a* and 10*b* illustrated in FIG. 2.

The signal processing apparatus 100 recognizes an image in content being reproduced (step S112). For example, if a large amount of seas, rivers, lakes, or the like are included in a video, the signal processing apparatus 100 can recognize that content being reproduced is a scene of a location near water, or a scene under water. In addition, for example, if a video is dark, and a large amount of rock surfaces or the like are included in the video, the signal processing apparatus 100 can recognize that content being reproduced is a scene in a cave.

Then, when the signal processing apparatus 100 performs image recognition processing on the content being reproduced, the signal processing apparatus 100 sets a parameter of effect processing to be executed on the environment sound acquired in step S111 described above, using a result of the image recognition processing performed in step S112 described above (step S113). When the signal processing apparatus 100 sets the parameter of the effect processing, the signal processing apparatus 100 executes the effect processing for the environment sound acquired in step S111 described above, using the parameter, and outputs a sound obtained after the effect processing.

By executing the operations as illustrated in FIG. 6, the signal processing apparatus 100 can set a parameter of effect processing for a sound in a real space, on the basis of what is included in content being reproduced. In other words, by executing the operations as illustrated in FIG. 6, the signal processing apparatus 100 can set a parameter of effect processing for a sound in a real space, on the basis of what is included in content being reproduced, even for content to which meta-information is not added.

[1.4. Third Configuration Example and Operation Example]

Figure 7:
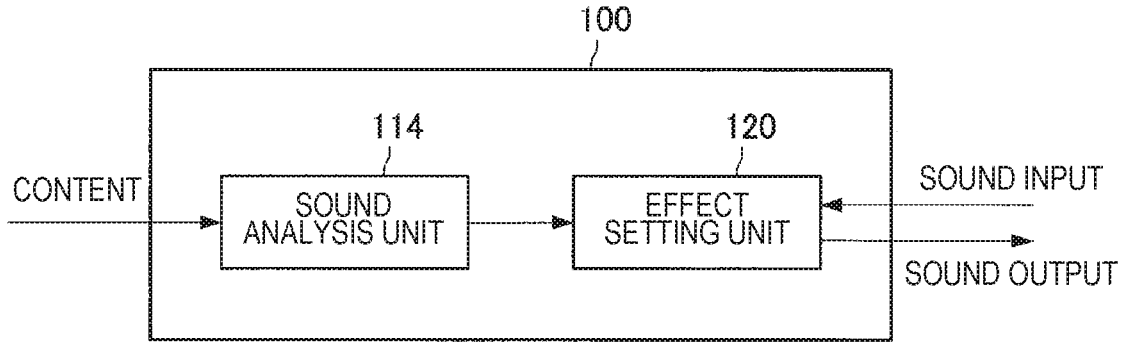
FIG. 7 is an explanatory diagram illustrating a third configuration example of a signal processing apparatus.

Next, the third configuration example and operation example of the signal processing apparatus 100 according to the embodiment of the present disclosure will be described. FIG. 7 is an explanatory diagram illustrating the second configuration example of the signal processing apparatus 100 according to the embodiment of the present disclosure. The third configuration example illustrated in FIG. 7 performs sound recognition processing for content being reproduced (by the display device 20 or the signal processing apparatus 100), and sets a parameter of effect processing for a sound in a real space, from a result of the sound recognition processing.

As illustrated in FIG. 7, the signal processing apparatus 100 includes a sound recognition unit 114 and the effect setting unit 120.

The sound recognition unit 114 executes sound recognition processing for content being reproduced. Because a parameter of effect processing for a sound in a real space is set from a result of the sound recognition processing, the sound recognition unit 114 performs sound recognition processing to such a degree that it is possible to identify the type of location used for a scene of content being reproduced. When the sound recognition unit 114 executes sound recognition processing for content being reproduced, the sound recognition unit 114 outputs a result of the sound recognition processing to the effect setting unit 120.

For example, if it is identified that a reverberating sound generated in a case where an object is dropped into water exists in a sound, the sound recognition unit 114 can recognize that content being reproduced is a scene of a location near water. In addition, for example, if it is identified that a reverberating sound of a cave exists in a sound, the sound recognition unit 114 can recognize that content being reproduced is a scene in a cave.

By performing effect processing on a sound emitted in a real space, the effect setting unit 120 performs signal processing of adding an acoustic characteristic of another space in content being reproduced, to the sound emitted in the real space. When performing the signal processing of adding an acoustic characteristic of another space, the effect setting unit 120 then sets a parameter of effect processing for the sound emitted in the real space, using the result of the sound recognition processing performed by the sound recognition unit 114.

For example, in a case where content being reproduced is recognized as a scene of a location near water, as a result of sound recognition processing performed by the sound recognition unit 114, the effect setting unit 120 sets a parameter of effect processing of adding a reverberant sound heard as if an object dropped on a water surface.

In addition, for example, in a case where content being reproduced is recognized as a scene in a cave, as a result of image recognition processing performed by the sound recognition unit 114, the effect setting unit 120 sets a parameter of effect processing of adding such reverberation that a listener feels as if the listener existed in a cave.

When the effect setting unit 120 sets a parameter of effect processing for a sound emitted in a real space, using a result of image recognition processing performed by the sound recognition unit 114, the effect setting unit 120 executes the effect processing for the sound emitted in the real space, using the parameter, and outputs a sound obtained after the effect processing.

By having a configuration as illustrated in FIG. 7, the signal processing apparatus 100 can set a parameter of effect processing for a sound in a real space, on the basis of what is included in content being reproduced. In other words, by having a configuration as illustrated in FIG. 7, the signal processing apparatus 100 can set a parameter of effect processing for a sound in a real space, on the basis of what is included in content being reproduced, even for content to which meta-information is not added.

Figure 8:
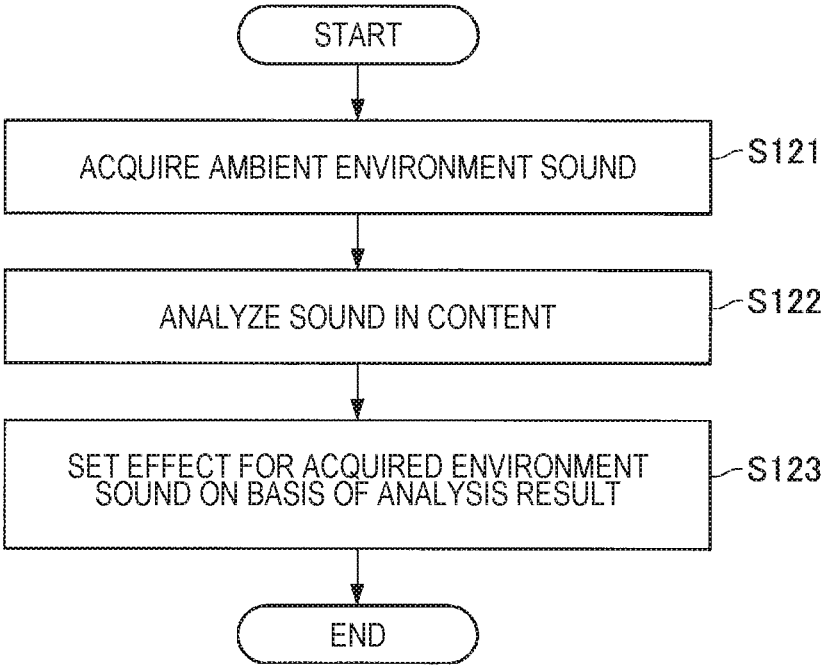
FIG. 8 is a flow chart illustrating a third operation example of the signal processing apparatus.

FIG. 8 is an explanatory diagram illustrating the second operation example of the signal processing apparatus 100 according to the embodiment of the present disclosure. The third operation example illustrated in FIG. 8 performs sound recognition processing for content being reproduced (by the display device 20 or the signal processing apparatus 100), and sets a parameter of effect processing for a sound in a real space, from a result of the sound recognition processing.

First of all, the signal processing apparatus 100 continuously acquires an ambient environment sound emitted in a real space (step S121). The acquisition of the environment sound is performed by, for example, the microphone 10 illustrated in FIG. 1 or the microphones 10*a* and 10*b* illustrated in FIG. 2.

The signal processing apparatus 100 recognizes a sound in content being reproduced (step S122). For example, if it is identified that a reverberating sound generated in a case where an object is dropped into water exists in a sound, the signal processing apparatus 100 can recognize that content being reproduced is a scene of a location near water. In addition, for example, if it is identified that a reverberating sound of a cave exists in a sound, the signal processing apparatus 100 can recognize that content being reproduced is a scene in a cave.

Then, when the signal processing apparatus 100 performs sound recognition processing on the content being reproduced, the signal processing apparatus 100 sets a parameter of effect processing to be executed on the environment sound acquired in step S121 described above, using a result of the sound recognition processing performed in step S122 described above (step S123). When the signal processing apparatus 100 sets the parameter of the effect processing, the signal processing apparatus 100 executes the effect processing for the environment sound acquired in step S121 described above, using the parameter, and outputs a sound obtained after the effect processing.

By executing the operations as illustrated in FIG. 8, the signal processing apparatus 100 can set a parameter of effect processing for a sound in a real space, on the basis of what is included in content being reproduced. In other words, by executing the operations as illustrated in FIG. 8, the signal processing apparatus 100 can set a parameter of effect processing for a sound in a real space, on the basis of what is included in content being reproduced, even for content to which meta-information is not added.

The signal processing apparatus 100 may determine which type of location is used for a scene in content, by combining extraction of metadata, video recognition, and sound recognition that have been described so far. In addition, in a case where content is content having no video, such as music data, the signal processing apparatus 100 may set a parameter of effect processing for a sound in a real space, by combining extraction of metadata and sound recognition.

[1.5. Fourth Configuration Example and Operation Example]

Next, the fourth configuration example and operation example of the signal processing apparatus 100 according to the embodiment of the present disclosure will be described. In the description given so far, in all the examples, the effect setting unit 120 sets a parameter of effect processing for a sound in a real space, on the basis of what is included in content being reproduced. When setting a parameter of effect processing for a sound in a real space, the effect setting unit 120 may search a server on a network for a parameter of effect processing.

Figure 9:
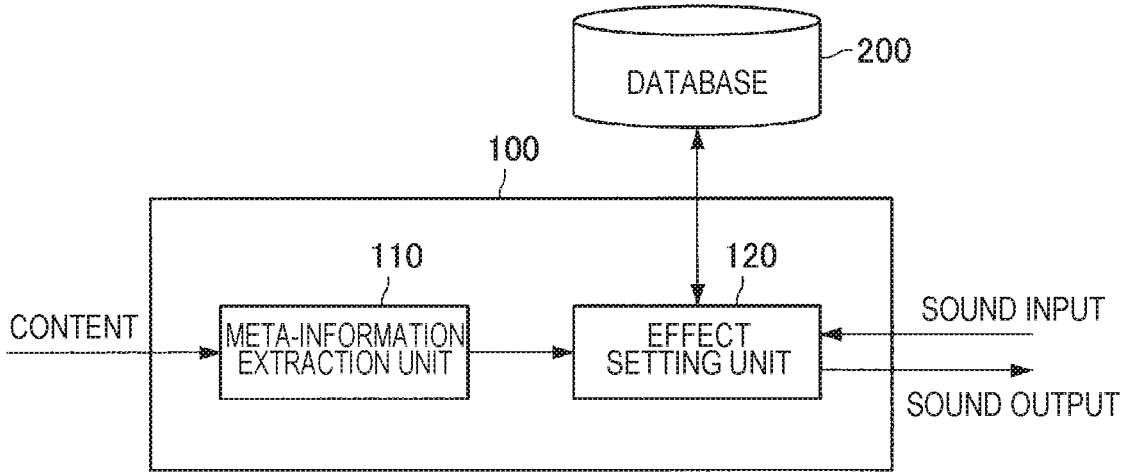
FIG. 9 is an explanatory diagram illustrating a fourth configuration example of a signal processing apparatus.

FIG. 9 is an explanatory diagram illustrating the fourth configuration example of the signal processing apparatus 100 according to the embodiment of the present disclosure. As illustrated in FIG. 9, the signal processing apparatus 100 includes the meta-information extraction unit 110 and the effect setting unit 120.

Similarly to the first configuration example illustrated in FIG. 3, the meta-information extraction unit 110 extracts meta-information from content being reproduced. The meta-information extraction unit 110 extracts, as meta-information, for example, meta-information such as a parameter and an effect name of an effect that has been pre-granted to the content. The meta-information extraction unit 110 outputs the extracted meta-information to the effect setting unit 120.

By performing effect processing on a sound emitted in a real space, the effect setting unit 120 performs signal processing of adding an acoustic characteristic of another space in content being reproduced, to the sound emitted in the real space. When performing the signal processing of adding an acoustic characteristic of another space, the effect setting unit 120 then sets a parameter of effect processing for the sound emitted in the real space, using the meta-information extracted by the meta-information extraction unit 110, similarly to the first configuration example illustrated in FIG. 3.

In this fourth configuration example, when setting a parameter of effect processing for a sound emitted in a real space, the effect setting unit 120 may search a database 200 placed in a server on a network to acquire the parameter of effect processing. A format of information to be stored in the database 200 is not limited to a specific format. Nevertheless, it is desirable to store information in the database 200 in such a manner that a parameter can be extracted from information such as an effect name and a scene.

For example, if meta-information output by the meta-information extraction unit 110 is an effect name, the effect setting unit 120 sets a parameter of effect processing for a sound emitted in a real space, on the basis of the effect name. Nevertheless, if the effect setting unit 120 does not hold a parameter corresponding to the effect name, the effect setting unit 120 acquires a parameter corresponding to the effect name, from the database 200.

For example, if meta-information output by the meta-information extraction unit 110 is an effect name called "inside a cave", and if the effect setting unit 120 does not hold a parameter of adding such an acoustic characteristic that a listener feels as if the listener existed in a cave, the effect setting unit 120 acquires, from the database 200, the parameter of effect processing of adding such an acoustic characteristic that a listener feels as if the listener existed in a cave.

By having a configuration as illustrated in FIG. 9, the signal processing apparatus 100 can set a parameter of effect processing for a sound in a real space, on the basis of meta-information pre-granted to content being reproduced (by the display device 20 or the signal processing apparatus 100).

Figure 10:
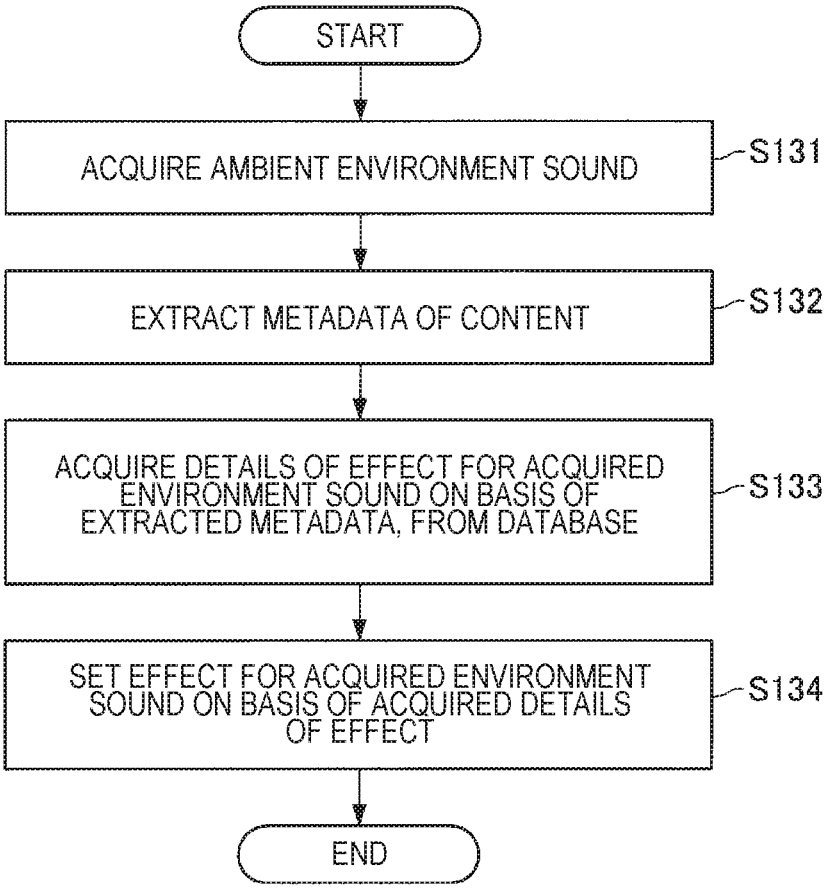
FIG. 10 is a flow chart illustrating a fourth operation example of the signal processing apparatus.

FIG. 10 is an explanatory diagram illustrating the fourth operation example of the signal processing apparatus 100 according to the embodiment of the present disclosure. By pre-granting meta-information such as a parameter and an effect name of an effect for a sound in a real space, to content being reproduced (by the display device 20 or the signal processing apparatus 100), and extracting the meta-information from the content, the fourth operation example illustrated in FIG. 10 sets a parameter of effect processing for a sound in the real space.

First of all, the signal processing apparatus 100 continuously acquires an ambient environment sound emitted in a real space (step S131). The acquisition of the environment sound is performed by, for example, the microphone 10 illustrated in FIG. 1 or the microphones 10*a* and 10*b* illustrated in FIG. 2.

The signal processing apparatus 100 extracts meta-information from content being reproduced (step S132). The signal processing apparatus 100 extracts, as meta-information, for example, meta-information such as a parameter and an effect name of an effect that has been pre-granted to the content. The signal processing apparatus 100 may execute the extraction of meta-information at predetermined intervals, or may execute the extraction at a time point at which switching of meta-information is detected.

When the signal processing apparatus 100 extracts the meta-information from the content being reproduced, the signal processing apparatus 100 acquires a parameter of effect processing to be executed on the environment sound acquired in step S131 described above, from the database 200 (step S133). The signal processing apparatus 100 then sets, as a parameter of effect processing to be executed on the environment sound acquired in step S131 described above, the parameter of effect processing that has been acquired in step S133 (step S134). When the signal processing apparatus 100 sets the parameter of the effect processing, the signal processing apparatus 100 executes the effect processing for the environment sound acquired in step S131 described, using the parameter, and outputs a sound obtained after the effect processing.

By executing the operations as illustrated in FIG. 10, the signal processing apparatus 100 can set a parameter of effect processing for a sound in a real space, on the basis of meta-information pre-granted to content being reproduced (by the display device 20 or the signal processing apparatus 100).

Note that, in the examples illustrated in FIGS. 9 and 10, the configuration and the operation of extracting meta-information from content being reproduced have been described. Nevertheless, as in the aforementioned second configuration example, video recognition processing may be performed on content being reproduced, and if the effect setting unit 120 does not hold a parameter corresponding to a result of the video recognition, the effect setting unit 120 may acquire a parameter corresponding to the effect name, from the database 200.

In addition, as in the aforementioned third configuration example, sound recognition processing may be performed on content being reproduced, and if the effect setting unit 120 does not hold a parameter corresponding to a result of the sound recognition, the effect setting unit 120 may acquire a parameter corresponding to the effect name, from the database 200.

[1.6. Fifth Configuration Example]

The configuration examples and operation examples of the signal processing apparatus 100 that set a parameter of effect processing by extracting meta-information from content being reproduced, or performing recognition processing of a video or a sound on content being reproduced have been described so far. As the next example, the description will be given of a configuration example of the signal processing apparatus 100, in which an acoustic characteristic is pre-granted to content, and a parameter of effect processing that corresponds to the acoustic characteristic is set.

Figure 11:
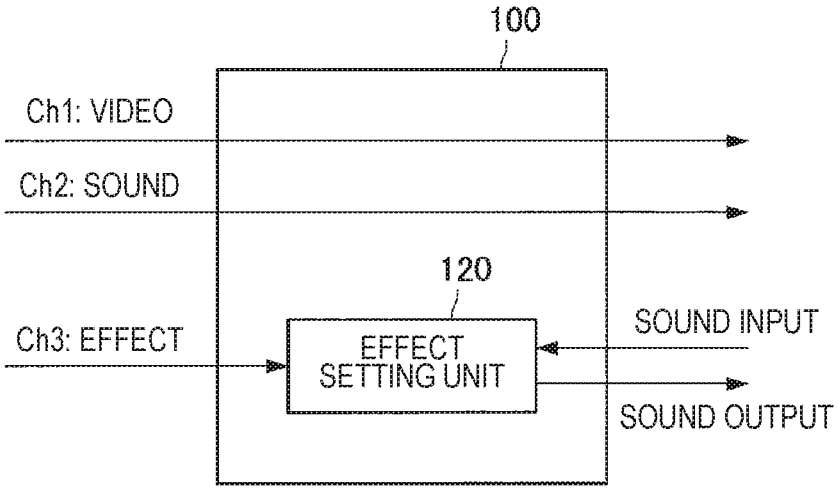
FIG. 11 is an explanatory diagram illustrating a fifth configuration example of a signal processing apparatus.

FIG. 11 is an explanatory diagram illustrating the fifth configuration example of the signal processing apparatus 100 according to the embodiment of the present disclosure. As illustrated in FIG. 11, the signal processing apparatus 100 includes the effect setting unit 120.

The effect setting unit 120 acquires information regarding an acoustic characteristic configured as one channel of content being reproduced, and sets a parameter of effect processing that corresponds to the acoustic characteristic. By setting the parameter of effect processing that corresponds to the acoustic characteristic of the content being reproduced, the effect setting unit 120 can add a more real acoustic characteristic of content being reproduced, to a sound in a real space.

If information regarding an acoustic characteristic is not included in content being reproduced, the signal processing apparatus 100 may execute processing of extracting meta-information from content being reproduced. In addition, if meta-information is not included in the content being reproduced, the signal processing apparatus 100 may execute video analysis processing or sound analysis processing of the content being reproduced.

[1.7. Modified Example]

Any of the aforementioned signal processing apparatuses 100 sets a parameter of effect processing for a sound in a real space by extracting meta-information from content, or analyzing a video or a sound in content. In addition to this, for example, the signal processing apparatus 100 may set a parameter of effect processing for a sound in a real space in accordance with an action of a user.

For example, the signal processing apparatus 100 may cause a user to select details of effect processing. For example, in a case where a scene in a cave appears in content being viewed by a user, and the user would like to cause a sound in a real space to echo as if the sound were emitted inside a cave, the signal processing apparatus 100 may enable the user to select performing such effect processing that a listener feels as if the listener existed in a cave. In addition, for example, in a case where a scene in a forest appears in content being viewed by a user, and the user would like to cause a sound in a real space not to echo too much, as if the sound were emitted in a forest, the signal processing apparatus 100 may enable the user to select performing effect processing of preventing a sound from reverberating.

In addition, the signal processing apparatus 100 may hold information regarding an acoustic characteristic in a real space in advance, or bring the information into a referable state, and change a parameter of effect processing for a sound in the real space in accordance with the acoustic characteristic of the real space. The acoustic characteristic in the real space can be obtained by analyzing a sound collected by the microphone 10, for example.

For example, in a case where a real space is a space where a sound easily reverberates, such as a conference room, when the signal processing apparatus 100 performs such effect processing that a listener feels as if the listener existed in a cave, a sound in the real space echoes too much. Thus, the signal processing apparatus 100 may adjust a parameter such that a sound in the real space does not echo too much. In addition, for example, in a case where a real space is a space where a sound is difficult to echo, such as a spacious room, the signal processing apparatus 100 may adjust a parameter such that a sound strongly echoes, when performing such effect processing that a listener feels as if the listener existed in a cave.

For example, the signal processing apparatus 100 may set a parameter of effect processing for a sound in a real space in accordance with sensing data output by a sensor carried or worn by a user. The signal processing apparatus 100 may recognize an action of a user from data of an acceleration sensor, a gyro sensor, a geomagnetic sensor, an illuminance sensor, a temperature sensor, a barometric sensor, and the like, for example, or acquire an action of the user that has been recognized by another device from the data of these sensors, and set a parameter of effect processing for a sound in a real space, on the basis of the action of the user.

For example, in a case where it can be recognized from the data of the above-described sensors that a user is concentrating, the signal processing apparatus 100 may set a parameter of effect processing of preventing a sound from reverberating. Note that a method of action recognition is described in many literatures such as JP 2012-8771A, for example. Thus, the detailed description will be omitted.

2. CONCLUSION

As described above, according to the embodiment of the present disclosure, the signal processing apparatus 100 that can cause, by adding an acoustic characteristic of content being reproduced in a real space, to a sound collected in the real space, a viewer of the content to feel such a sensation that a space of the content being reproduced in the real space is expanded to the real space is provided.

It may not be necessary to chronologically execute respective steps in the processing, which is executed by each device of this specification, in the order described in the sequence diagrams or the flow charts. For example, the respective steps in the processing which is executed by each device may be processed in the order different from the order described in the flow charts, and may also be processed in parallel.

Furthermore, it becomes possible to generate a computer program which makes a hardware device, such as a CPU, a ROM, and a RAM incorporated in each device demonstrate the functions equivalent to the configurations of the above described devices. In addition, it becomes also possible to provide a storage medium which stores the computer program. In addition, respective functional blocks shown in the functional block diagrams may be constituted from hardware devices or hardware circuits so that a series of processes may be implemented by the hardware devices or hardware circuits.

In addition, some or all of the functional blocks shown in the functional block diagrams used in the above description may be implemented by a server device that is connected via a network, for example, the Internet. In addition, configurations of the functional blocks shown in the functional block diagrams used in the above description may be implemented in a single device or may be implemented in a system in which a plurality of devices cooperate with one another. The system in which a plurality of devices cooperate with one another may include, for example, a combination of a plurality of server devices and a combination of a server device and a terminal device.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A signal processing apparatus including:

a control unit configured to decide a predetermined acoustic characteristic for causing a user to hear a collected ambient sound of the user in a space having a different acoustic characteristic, in accordance with content being reproduced, or an action of a user, and to add the decided acoustic characteristic to the ambient sound.

(2)

The signal processing apparatus according to (1), in which, in a case of deciding an acoustic characteristic in accordance with content being reproduced, the control unit decides an acoustic characteristic in accordance with a scene of the content.

(3)

The signal processing apparatus according to (2), in which the control unit determines a scene of the content by analyzing an image or a sound in the content.

(4)

The signal processing apparatus according to (2), in which the control unit determines a scene of the content on a basis of metadata granted to the content.

(5)

The signal processing apparatus according to any of (1) to (4), in which, in a case of deciding an acoustic characteristic in accordance with content being reproduced, the control unit adds an acoustic characteristic granted to the content, to the ambient sound.

(6)

The signal processing apparatus according to (1), in which, in a case of deciding an acoustic characteristic in accordance with an action of a user, the control unit decides an acoustic characteristic in accordance with sensing data output by a sensor carried or worn by the user.

(7)

The signal processing apparatus according to (1), in which, in a case of deciding an acoustic characteristic in accordance with an action of a user, the control unit adds an acoustic characteristic selected by the user, to the ambient sound.

(8)

The signal processing apparatus according to any of (1) to (7), in which the control unit decides an acoustic characteristic considering an acoustic characteristic of a space where a microphone that acquires the ambient sound is placed.

(9)

A signal processing method including:

executing, by a processor, processing of deciding a predetermined acoustic characteristic for causing a user to hear a collected ambient sound of the user in a space having a different acoustic characteristic, in accordance with content being reproduced, or an action of a user, and adding the decided acoustic characteristic to the ambient sound.

(10)

A computer program for causing a computer to execute:

deciding a predetermined acoustic characteristic for causing a user to hear a collected ambient sound of the user in a space having a different acoustic characteristic, in accordance with content being reproduced, or an action of a user, and adding the decided acoustic characteristic to the ambient sound.

REFERENCE SIGNS LIST

10, 10*a*, 10*b* microphone
11 table
12, 12*a*, 12*b* speaker
100 signal processing apparatus

The invention claimed is:

1. A signal processing apparatus, comprising:

circuitry configured to:

acquire a specific signal from a specific device, wherein the specific signal represents ambient sound of a first environment;

detect a change of metadata of content reproduced in the first environment;

extract the changed metadata of the content based on the detection;

determine, based on the extracted metadata of the content reproduced, a scene in the content reproduced, wherein the first environment has a first acoustic characteristic;

determine a second acoustic characteristic, corresponding to a second environment, based on the scene in the content reproduced in the first environment, wherein the second acoustic characteristic is different from the first acoustic characteristic;

generate an audio signal based on addition of the second acoustic characteristic to the specific signal; and output the generated audio signal in the first environment.

2. The signal processing apparatus according to 1, wherein the circuitry is further configured to generate the audio signal based on addition of the specific signal to a third acoustic characteristic of the content reproduced, and the third acoustic characteristic corresponds to at least one of a parameter or an effect associated with the content reproduced.

3. The signal processing apparatus according to 1, wherein the circuitry is further configured to:

receive sensing data from a user carried sensor; and determine the second acoustic characteristic based on the sensing data.

4. The signal processing apparatus according to 1, wherein the circuitry is further configured to generate the audio signal based on addition of a user selected acoustic characteristic to the specific signal.

5. The signal processing apparatus according to 1, wherein the specific device is a microphone, and the circuitry is further configured to determine the second acoustic characteristic based on a specific acoustic characteristic of a space where the microphone that acquires the ambient sound is placed.

6. A signal processing method, comprising:

acquiring a specific signal from a specific device, wherein the specific signal represents ambient sound of a first environment;

detecting a change of metadata of content reproduced in the first environment;

extracting the changed metadata of the content based on the detection;

determining, based on the extracted metadata of the content reproduced, a scene in the content reproduced, wherein the first environment has a first acoustic characteristic;

determining a second acoustic characteristic, corresponding to a second environment, based on the scene in the content reproduced in the first environment, wherein the second acoustic characteristic is different from the first acoustic characteristic;

generating an audio signal based on addition of the second acoustic characteristic to the specific signal; and outputting the generated audio signal in the first environment.

7. A non-transitory computer-readable medium having stored thereon computer-executable instructions that, when executed by a computer, cause the computer to execute operations, the operations comprising:

acquiring a specific signal from a specific device, wherein the specific signal represents ambient sound of a first environment;

detecting a change of metadata of content reproduced in the first environment;

extracting the changed metadata of the content based on the detection;

determining, based on the extracted metadata of the content reproduced, a scene in the content reproduced, wherein the first environment has a first acoustic characteristic;

determining a second acoustic characteristic, corresponding to a second environment, based on the scene in the content reproduced in the first environment, wherein the second acoustic characteristic is different from the first acoustic characteristic;

generating an audio signal based on addition of the second acoustic characteristic to the specific signal; and outputting the generated audio signal in the first environment.

* * * * *